United States Patent [19]

Barnhouse

[11] Patent Number: 4,740,166

[45] Date of Patent: Apr. 26, 1988

[54] CIRCUIT BOARD PIN

[75] Inventor: Robert L. Barnhouse, Royal Palm Beach, Fla.

[73] Assignee: Northern Telecom Limited, Montreal, Canada

[21] Appl. No.: 58,901

[22] Filed: Jun. 5, 1987

[51] Int. Cl.[4] ..... H01R 13/428

[52] U.S. Cl. ..... 439/82; 439/751

[58] Field of Search ..... 439/78, 81–84, 439/720, 736, 733, 741, 751, 825–827, 869, 870, 873, 874, 876

[56] References Cited

U.S. PATENT DOCUMENTS

| | | | |
|---|---|---|---|
| 4,585,293 | 4/1986 | Czeschka et al. | 439/82 |
| 4,691,979 | 9/1987 | Manska | 439/82 |
| 4,698,026 | 10/1987 | Rolf | 439/82 |

FOREIGN PATENT DOCUMENTS

| | | | |
|---|---|---|---|
| 3220781 | 12/1983 | Fed. Rep. of Germany | 439/751 |

OTHER PUBLICATIONS

Electrotechnike, p. 22, Feb. 1981.

1985 Methode Electronics Inc. Catalog, p. 11 and additional photographs.

*Primary Examiner*—Gil Weidenfeld

*Assistant Examiner*—Gary F. Paumen

*Attorney, Agent, or Firm*—Schwartz, Jeffery, Schwaab, Mack, Blumenthal & Evans

[57] ABSTRACT

A circuit board pin with a compliant portion having two side-by-side beams joined together along one edge of each beam. At the join, the beams hinge relative to each other and opposing tapered surfaces of the beams diverge from the hinge. A convex continuously smooth surface extends around the beams to make the beams thicker as they extend away from the hinge. The compliant portion is made within a closed mold by displacing material into the shape of the mold cavity.

6 Claims, 4 Drawing Sheets

CIRCUIT BOARD PIN

This invention relates to circuit board pins.

Soldering has traditionally been accepted for providing electrical connections. Certain electrical connections are, however, made difficult to form by the use of soldering techniques. For instance, it has been found that soldering imposes restrictions in design of printed circuit boards because of problems associated with inserting circuit board pins into holes in the boards and connecting the pins to electrically conductive surfaces of the holes.

The development of circuit board pins having compliant portions has overcome the soldering problems, but has introduced other problems. The compliant portions of these pins are oversize for the holes in boards into which they are to be fitted. To assemble the pins and boards, the compliant portions are forced into the holes by press-fit techniques which deform the compliant portions inwardly of the pins. Resilient deformation ensures a tight fit of the compliant portions in the holes and a good metal-to-metal contact between the pins and the surface material forming the holes. Unfortunately, certain pin designs have compliant portions with surfaces which meet at junction positions to form corners in cross-section of the pins. These corners tend to cut into the conductive lining material of the holes under the outward resilient pressure of the inwardly deforming compliant portions. Cutting or wearing action also occurs when the compliant portions provide relatively small contact surface areas with the conductive lining material of the holes. The wall thickness of lining material is normally around 0.0015 inches and the lining material may be completely cut through by a compliant portion of a pin. After a cutting action, copper material of the lining may then break away to expose the surface of the board material. This results in less contact area between the lining material of the hole and the pin and resultant decrease in passage of current. In the case of multi-layer boards, aging, temperature changes and temperature cycling and presence of moisture are known to cause delamination and breaking away of the board material following breaking away of the copper lining material. Oxidization of the conductive layers between the multi-layers increases resistance to passage of the current.

One pin design has a compliant portion which is of C-shaped cross-section and has an outer continuously convex surface. Resilient deformation occurs at all positions around the compliant portion to produce movement towards each other of the ends of the C-shape and its accompanying reduction in radius. The convex outer surface of the compliant portion provides a large contact area with the conductive lining material of the hole and thus more even distribution of the pressure than is obtainable with other pin designs. As a result, there is a reduced tendency for the C-shaped compliant portion to cut into the conductive lining material of the hole.

However, compliant pins having C-shaped compliant portions require a multitude of incremental forming steps performed by press tools to produce them. The tooling for these consecutive operations is extremely expensive and precise and is intended to produce precisely shaped compliant portions. Tooling expense is partly due to the tool design required to precisely control the shape of transition zones between the compliant portions and wire terminal portions of the pins. Nevertheless, symmetry problems do occur and in some pins, the compliant portions are weaker at one side of the C-shape than at the other. This may result in twisting of asymmetrical pins as they are forced into the holes and gouging into conductive lining material. Also, the incremental forming steps sometimes produce random flashes of metal between press tools and this leads to assembly and conduction problems. In addition, the transition zones between the C-shaped compliant portions and wire terminal portions of the pins are axially short and are inclined to be weak such that breakage may occur when the pins are inserted.

The present invention seeks to provide a compliant pin designed to have a large contact area with conductive lining material or holes into which it is to be fitted while overcoming problems associated with a pin having a C-shaped compliant portion. The invention also seeks to provide a method of forming a compliant pin which overcomes problems associated with other pin forming methods.

Accordingly, the present invention provides a circuit board pin having a compliant portion extending along part of its length and another section extending from the compliant portion, the pin comprising two beams extending along the compliant portion, the beams extending laterally from and integrally joined together by a concentrated resilient hinge region of the compliant portion for resilient movement towards each other of the beams, the beams also increasing in thickness laterally away from the hinge region and having opposing inner surfaces diverging from the hinge region to define an inwardly tapering groove between the beams, the compliant portion having a convex continuously smooth outer surface which extends around the beams and hinge region, and the beams merging at one end into the other pin portion at a transition zone.

The circuit board pin according to the invention operates to provide a gas tight fit within a hole by resilient deformation of the hinge region to move the opposing surfaces of the beams towards each other. This resilient deformation is concentrated at the thinner hinge region and negligible, if any, resilient deformation occurs at thicker parts of the beams. The beams have considerable mass away from the hinge region whereby merging of the beams together and into the other pin portion does not result in drastic changes in mass or cross-sectional dimensions of the pin whereby the pin is not unduly weakened at the transition zone.

The pin according to the invention may be made simply by a combined cold worked molding and coin punching process. In this process, a mold is closed around part of the pin to form the compliant portion to provide a mold cavity with cavity parts unoccupied by the pin, and a coining punch is moved across the cavity to apply pressure to the pin and deform it to cause it to be displaced into unoccupied parts of the cavity. Such a process may be performed incrementally in stages, but may easily be performed in a one or two stage operation. Displacement molding into a mold cavity also closely controls the shape of the compliant portion to provide symmetry to the structure. Also, as mold closure occurs before the deformation process, the formation of flash is avoided.

Accordingly, the invention also provides a method of forming a circuit board pin having a compliant portion along part of its length and another portion extending from the compliant portion, comprising forming the compliant portion by closing mold parts around said part of the length of the pin to provide a mold cavity containing said length part with the length part firmly stabilized in position laterally while providing empty cavity portions unoccupied by said length part, and with the mold part closed, moving a tapered coining punch partly across the mold cavity to reduce the volume of the cavity and displace material of the length part laterally and to each side of the punch and into empty cavity portions: (a) to provide the pin with two beams of the compliant portion, one at each side of the punch which forms an inwardly tapered groove between the beams, the punch terminating on its working stroke a distance from an opposite wall of the mold cavity to provide a concentrated resilient hinge region integral with and between the two beams and to provide the beams with an increase in thickness as they extend laterally away from the hinge region; and (b) to provide the compliant portion with a continuously smooth outer surface which extends around the beams and hinge region with the beams merging at one end into the other portion of the pin at a transition zone.

With the process according to the invention, displacement molding minimizes any possibility of asymmetry of the compliant portion. Also, because the compliant portion is formed within a closed mold cavity, the production of flash is minimized.

Preferably, in the inventive method, formation of the compliant portion takes place in one operation, i.e. the beams and hinge region are formed by a single displacement operation within the mold cavity from a shaped preform which will fit within the cavity while being positionally stabilized.

Also, in a preferred manner of performing the method, in the transition zone between the compliant portion and the other portion of the pin, material at the two end regions of the compliant portion is displaced longitudinally of the pin in an uncontrolled and unrestricted manner. This lack of restriction on the flow of material provides the advantage that the beams and the hinge region are allowed to merge naturally with the other portion of the pin without placing undue stresses and strains upon the transition zone as by the use of mold surfaces.

The invention further includes an apparatus for making a circuit board pin comprising mold parts relatively movable between open and closed positions, the mold parts in their closed positions defining a mold cavity having a mold surface to provide a convex continuously smooth outer surface of a compliant portion of the pin, a coining punch having a tapered end, the mold parts in their closed positions defining a passage for movement on the punch on a working stroke to allow for movement of the tapered end of the punch partly across the mold cavity, and means for moving the mold parts between the open and closed positions and for moving the punch on its working stroke.

In a preferred practical arrangement, the apparatus includes a means for intermittently moving strip material along the feedpath, a compliant portion forming station at a certain position on the feedpath with the mold parts, coining punch and moving means operably disposed in the compliant portion forming station, a compliant portion preform forming station upstream along the feedpath from the compliant portion forming station, and a forming means in the preform forming station for forming a preform for the compliant portion.

It is also to be preferred that the mold parts in the relatively closed positions define an opening at each end of the mold cavity. With this arrangement, material at the two ends of the compliant portion may be displaced longitudinally of the pin in an unrestricted and uncontrolled manner so as to allow for the natural merging of the beams and hinge region with the other pin portion at the transition zone. Also, the provision of an opening to each end of the mold cavity simplifies the manufacture of the mold parts while reducing their cost. For instance, in a particularly preferred arrangement, each mold part has a mold surface with a shape and dimensions which remain constant from cross-section to cross-section between the ends of the mold part with the mold surface extending in rectilinear fashion in any section taken longitudinally along the mold part. This shape for the mold surface enables it to be made economically by a simple straight machining operation from end-to-end of the mold part. This simplicity in mold part manufacture avoids the difficult and expensive machinery operations in the manufacture of the ends of press cavities for the manufacture of compliant portions for circuit board pins of other designs.

One embodiment of the invention will now be described, by way of example, with reference to the accompanying drawings, in which.

Figure 8:
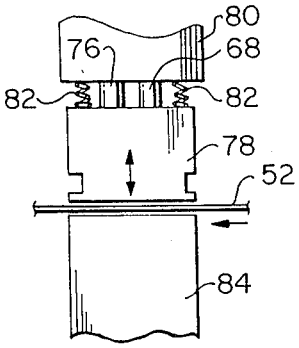
FIG. 8 is a side elevational view of part of the apparatus of performing the process of FIG. 5 with the apparatus in an open position.
Figure 12:
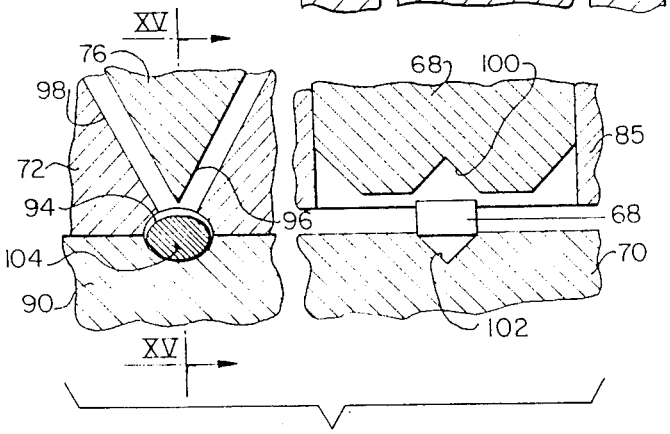
Figure 13:
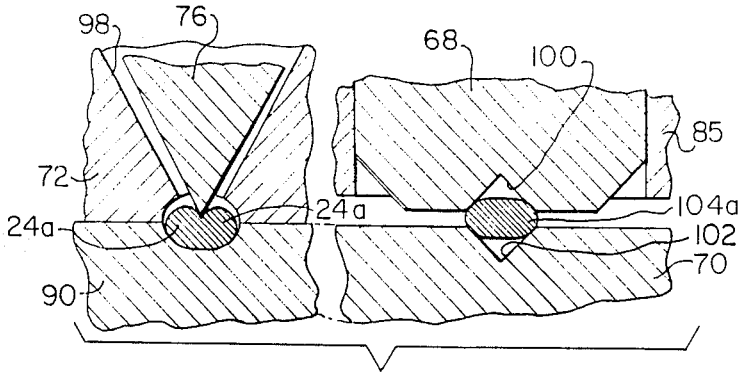
Figure 14:
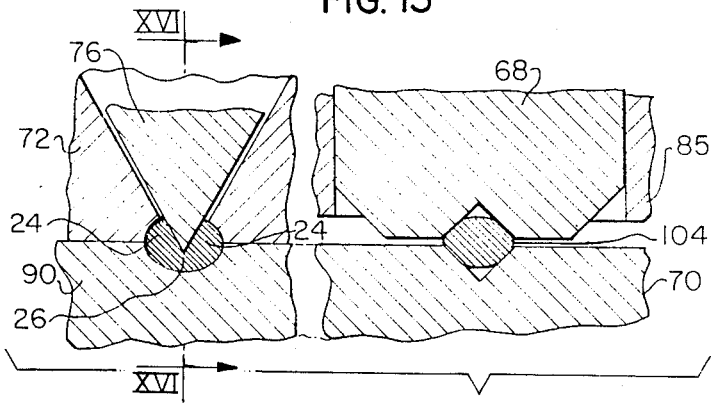
Figure 15:
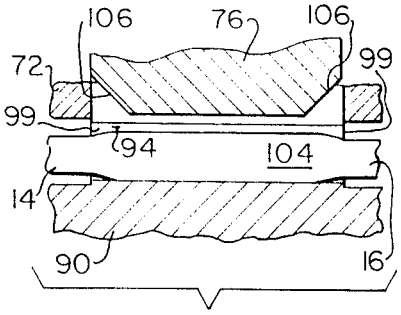
Figure 16:
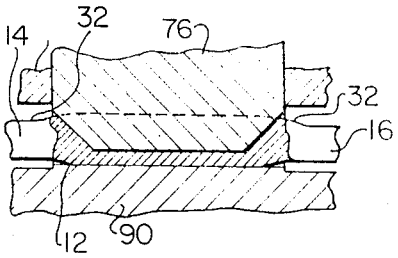

FIGS. 12, 13 and 14 are cross-sectional views in the direction of FIG. 8 and to a much larger scale, showing apparatus parts in succeeding operational positions during formation of a compliant portion of the pin; and FIGS. 15 and 16 are cross-sectional views, to the same scale as FIGS. 12 to 14, taken along lines XV—XV and XVI—XVI respectively in FIGS. 12 and 14.

Figure 1:
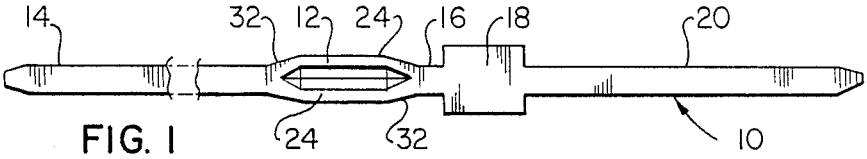
FIG. 1 is a plan view of a circuit board pin.
Figure 2:
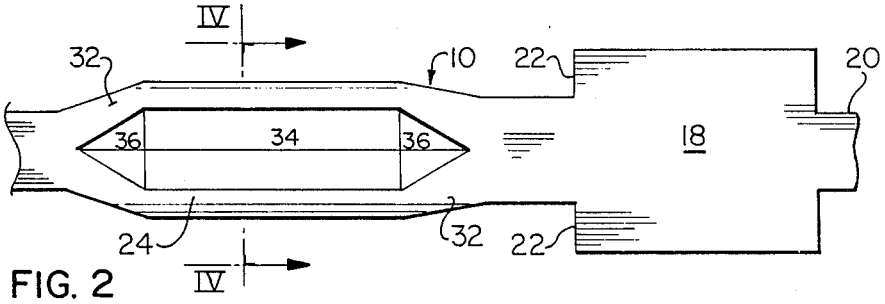
FIG. 2 is a plan view of a compliant portion of the pin and to a larger scale.
Figure 3:
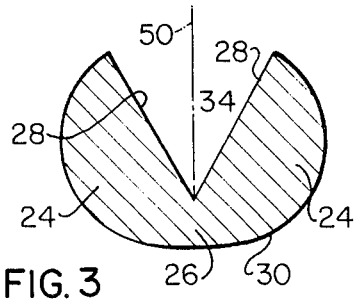
FIG. 3 is an isometric view of the compliant portion of the pin.

In the embodiment as shown in FIG. 1, a circuit board pin 10 comprises a compliant portion 12 extending along part of its length. The compliant portion extends at one end into an end portion 14 of the pin and at the other end into a neck portion 16 of the pin which is integral with an intermediate wider portion 18 and a wire terminal portion 20 at the other end of the pin. As shown by FIG. 3, the end portion 14 and neck portion 16 are of rectangular cross-section. The wire terminal portion 20 is of similar cross-section. The intermediate portion 18 is wider in plan view as shown in FIGS. 1, 2 and 3 to provide two shoulders 22.

Figure 4:
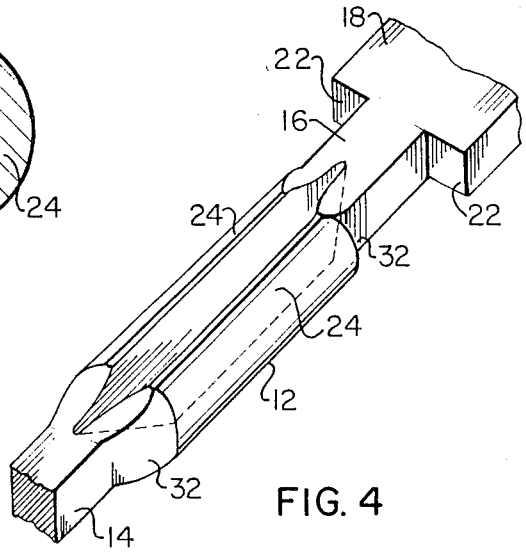
FIG. 4 is a cross-sectional view of the compliant portion taken along line IV—IV in FIG. 2 and to a larger scale.

The compliant portion 12 of the pin comprises two beams 24 which extend along the compliant portion. These two beams lie side-by-side, as shown in FIG. 4, and are integrally joined together along one edge of each of the beams by a concentrated resilient hinge region 26 of the compliant portion. The beams increase in thickness away from the hinge region, as shown particularly in FIG. 4, and have planar opposing inner surfaces 28 which diverge as they extend laterally away from the hinge region. The compliant portion also has a convex continuously smooth outer surface 30 which extends around the two beams and the hinge region to a junction with the surfaces 28 at edges of the beams remote from the hinge region. Because of the increasing thickness of the beams laterally from the hinge region, then the beams themselves have greater lateral stiffness than the hinge region thereby ensuring that the resiliency of the structure is confined to the hinge region. The hinge region allows for relative resilient movement towards each other of the two beams so that the angle between the surfaces 28 decreases as will be described below.

The depth and width of the compliant portion are greater than those of the end and neck portions 14 and 16. The compliant portion tapers at each end into the end and neck portions at a transition zone 32. As can be seen from FIGS. 1 to 3, along the transition zone the two beams gradually change shape so as to merge together and also merge into the rectangular shapes of the end and neck portions. As indicated above, each of the beams 24 has a greater thickness laterally from the hinge region 26 and this thickening of the beams provides substantial mass to the compliant portion with the cross-sectional area of the compliant portion being at least substantially equal to, but in this embodiment, greater than that of each of the portions 14 and 16. Thus, as there is no area reduction at the compliant portion there is no weakening of the structure. A V-shaped groove 34, which is formed between the inner surfaces 28, reduces progressively in depth together with a reduction in the width of the groove at each of its ends 36 in the transition zone so as to allow for progressive change in shape from the compliant to the end and neck portions.

Figure 5:
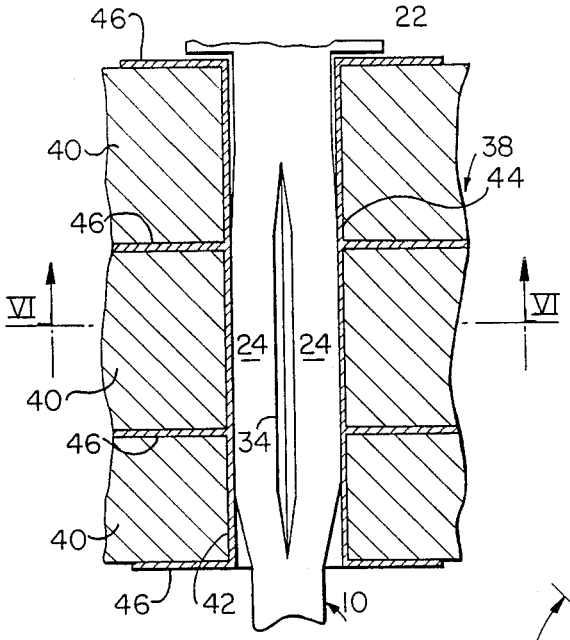
FIG. 5 is a plan view of the compliant portion of the pin showing it mounted in a pin receiving hole of a printed circuit board.
Figure 6:
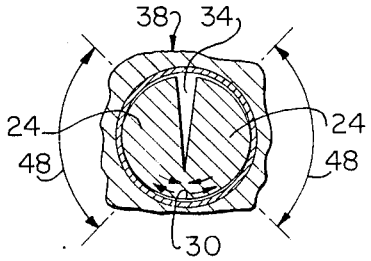
FIG. 6 is a cross-sectional view through the assembled pin and board taken along line VI—VI in FIG. 5 and to the same scale as FIG. 4.

The circuit board pin 10 is intended to be assembled into a conductively lined hole of a circuit board. For instance as shown in FIGS. 5 and 6, a multi-layer circuit board 38 comprises three layers 40 through which are provided a plurality of holes 42 (one only being shown). Each of the holes 42 is lined in conventional manner with a conductive lining material 44 and conductive layers 46 of an electrical circuit are provided extending away from the material 44, at each side of the multi-layer board and also between the board layers themselves.

The pin 10 is inserted into its respective hole 44 by passage of the end portion 14 through the hole and then the adjacent transition zone 32, followed by the compliant portion 12. As the transition zone moves through the hole, it engages the conductive material 44, and as insertion proceeds, the conductive material 44 bears upon the transition zone and then upon the two beams to apply a radial pressure to cause resilient inward movement of the beams. Because the beams are laterally rigid at their thickened sections, then such inward deformation may only take place by movement of the beams towards each other caused by resilient deformation at the hinge region 26. This has the effect of significantly reducing the width of the groove 34, as shown in FIG. 6, accompanied by compression placed in the material at the hinge portion directly beneath the base of the groove and tension in the material at the hinge region closer to the outer surface 30. This is shown by the direction of the arrows in the hinge region in FIG. 6. The shape of the outer surface 30 is predetermined so that in the assembled condition of the pin into its hole, there is a substantial arc of contact 48 between each beam and the conductive material 44. This is clear from FIG. 6.

As can be seen from the above description, two effects are provided by the cross-sectional area of the compliant portion being greater than the end and neck portions and by the thick beam structure away from the hinge region 26. The one effect is that the resilient deformation of the compliant pin takes place substantially completely in the hinge region and as a second effect, there is a resultant strengthening to the transition zones at the ends of the compliant portion. As a result of this, the possibility of the pin shearing in the compliant portion or in the transition zones is minimized to produce a negligible amount of pin failures during and after assembly into printed circuit boards.

The compliant portion of the pin also has a substantial degree of symmetry about a longitudinal median plane 50 (FIG. 4) passing along the groove 34 and through the center of the compliant portion. This high degree of symmetry is produced by the method and apparatus to be described, and ensures that during insertion of the pin, no undesirable pin twisting or rotation will occur.

Figure 7:
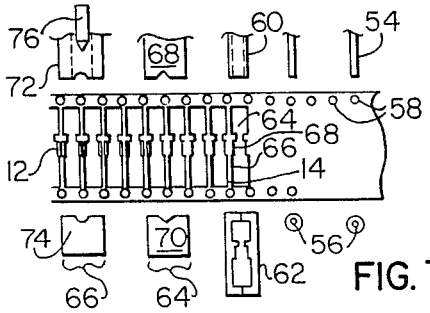
FIG. 7 is a diagrammatic representation showing an automated process for the progressive forming of circuit board pins of FIG. 1.

FIG. 7 shows diagrammatically the main parts of the apparatus used in making pins 10 consecutively by a continuous process. As shown by FIG. 7, a strip 52 of conductive material is fed in intermittent fashion along a passline by a moving means (not shown). The moving means is a conventional drive mechanism for controlling the forward movement of the strip. In an upstream position along the passline, the apparatus comprises pilot hole punches 54 on one side of the passline and pilot hole pierce inserts 56 on the other for forming pilot holes 58 along the two edges of the strip as it moves along the passline. Downstream from the pilot hole punches at a subsequent station, are located a contact trim punch 60 and contact trim insert 62, one at each side of the passline for punching out shaped apertures 64 in the strip 52 to provide basic pin preform shapes 66. As can be seen from FIG. 7, these preform shapes 66 are already provided with the substantially finished end portions 14 and also wider portions 68 lying adjacent to the portions 14. Each portion 68 is for forming a compliant portion 12 and, as will be appreciated, as each portion 68 is wider than, but of the same thickness as, its associated end portion 14, then the lateral cross-sectional area through each portion 68 is greater than that for an end portion 14. As will be clear from the following description, all of the material in each portion 68 is used for making a compliant portion 12 of its respective pin with the result that the cross-sectional area of the finished compliant portion is always greater than that of the end portion 14 as has previously been discussed.

Downstream from the punch 60 and the insert 62 are located parts of the apparatus for forming the compliant portions of the successive pins. These parts of the apparatus are disposed at a compliant portion preform forming station 64 downstream from the punch 60 and insert 62, and a compliant pin forming station 66 which lies further downstream. With reference to FIG. 7, in the station 64, a preform forming means comprises a preform forming punch 68 on one side of the feedpath and a preform forming die 70 on the other side of the feedpath. At the compliant portion forming station, there is disposed a mold comprising upper and lower mold parts 72 and 74, disposed at each side of the passline, and a coining punch 76 which, as will be described, is movable through the mold part 72 to displace material of a preform and form it into a compliant portion 12.

The parts of the apparatus disposed in stations 64 and 66 will now be described in greater detail with reference to FIGS. 8 through 16.

Figure 9:
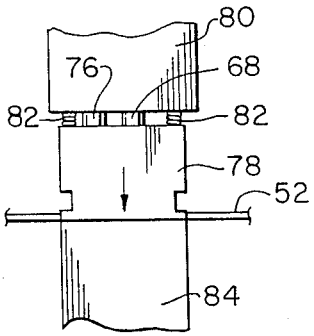
FIG. 9 is a view similar to FIG. 6 showing the part of the apparatus in closed position.

As shown in FIGS. 8 and 9, both the preform forming punch 68 and the coining punch 76 are vertically slidably movable within a punch block 78 disposed above the passline and urged downwardly from a ram 80 upon compression springs 82. The punches 68 and 76 are secured at their upper ends to the ram so that, after the punch block has reached its lower limit of travel illustrated in FIGS. 9 and 13, then continued downward movement of the ram will urge the punches through the punch block. Beneath the passline is disposed a die block 84 which securely holds in position the forming die 70 and the lower mold part 74.

Figure 10:
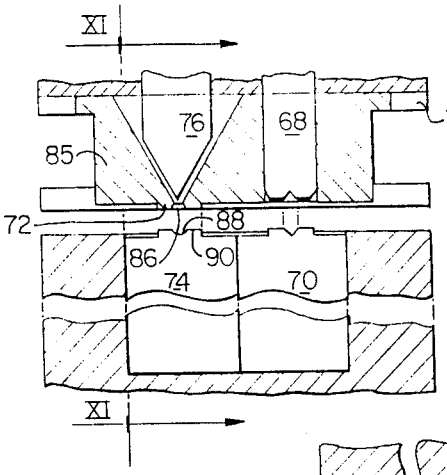
FIG. 10 is a cross-sectional view through the apparatus in the direction of FIG. 8 and to a larger scale, and shows the apparatus in an open position and in greater detail.
Figure 11:
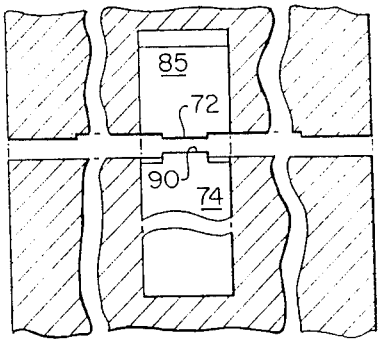
FIG. 11 is a cross-sectional view through the apparatus taken along line XI—XI in FIG. 10.

As is shown in more detail in FIG. 10, the mold part 72 is provided by a downwards extension from a stripper plate 85 which extends across both stations 64 and 66 and acts as a guide for the lower ends of the punches 68 and 76. The stripper plate 85 is secured to the punch block 78. The mold part 72 defines a concave upper surface 86 for a mold cavity, and the lower surface 88 for the cavity is provided by an upper projection 90 of the mold part 74. With the punch block and thus the stripper plate 85 in its lower position, as seem from FIG. 12 onwards, edges of the strip of material 52 are gripped and also the strip accurately held in position by the entrance of pilot pins (not shown) into the preformed pilot holes 58. The use of pilot pins in this regard is conventional for forming circuit board pins and needs no further description. In addition to this, with the punch block in its lower position, the mold part 72 engages the projection 90 of the lower mold part. Hence in the lower position, the surfaces 86 and 88 define a mold cavity 94 (FIG. 12) for the formation of compliant portions of the circuit board pins as they are moved through station 66. The lower end 96 of the coining punch 76 is tapered and the stripper plate 85 is provided with a tapered passage 98 which opens through the surface 86 into the mold cavity 94. Thus when the punch block 78 and the mold part 72 have reached their lower positions shown in FIGS. 9 and 12, continued downward movement of the ram moves the tapered end 96 of the punch 76 downwards into and partly across the mold cavity 94. This is illustrated by a comparison of FIGS. 12, 13 and 14.

The surfaces 86 and 88 are of simple construction and are formed as straight through cavities from end-to-end of the mold parts. Thus in the closed condition, the mold cavity 94 has two open ends 99 as can be seen from FIGS. 15 and 16. Hence, each mold surface 86 and 88 is of constant cross-sectional shape from end-to-end of its mold part and extends rectilinearly from end-to-end of the mold part.

The preform forming punch 68 is formed with a lower forming groove 100 which is of V-shape and the die 70 is formed with a similar groove 102 which lies directly below the groove 100.

In use of the apparatus, the punch block is in its upper position and the strip 52 is moved intermittently from one position to another along its feedpath in the direction of the arrow in FIG. 8. After each intermittent movement of the strip, the ram descends to move the punch block into engagement with the die block so as to hold the strip accurately in position during the forming operations. Upon the punch block engaging the die block 84, the mold part 72 engages the upper portion 90, as shown in FIG. 12, and a previously made preform 104 is disposed within the cavity 94. The dimensions of the preform are such that, with the mold closed, the preform engages surface parts of the mold in spaced positions as shown in FIG. 12 so as to stabilize the preform accurately in position laterally while providing empty cavity portions (unoccupied by the preform) as shown clearly by the figure. Also, in this position of the apparatus, the punch 68 is spaced upwardly from the die 70 and the portion 68 of a succeeding circuit board pin is located above the groove 102.

As the ram continues to move downwardly, the punch 68 descends until the groove surface 100 engages the portion 68. Continued downward movement then deforms this portion into a succeeding preform 104 as shown in FIG. 14. An intermediate stage in this process is shown in FIG. 13 in which the partly formed preform **104*a* is shown. During the downward movement of the ram, the punch 76 also descends so that the lower tapered end 96 enters the mold cavity 94 and moves partly across the cavity. During this movement, the lower end 96 of the punch engages the upper surface of the preform 104 for substantially the whole length along the preform and displaces material of the preform laterally and to each side of the punch, as illustrated in successive stages in the punching operation in FIGS. 13 and 14. This movement forces the material into previously empty cavity portions of the mold cavity whereby the two beams 24 are formed (see FIG. 14) with an intermediate stage for the beams 24*a* shown in FIG. 13. The punch terminates on its working stroke a distance from the lower wall or surface of the mold cavity. Material between the end of the punch and the surface 88 provides the concentrated resilient hinge region 26 of the compliant portion being formed. As can also be seen from FIGS. 12 to 14, the whole of the surface 88 becomes engaged by the material being displaced which conforms to the surface 88 and to most of the surface 86 so as to provide the continuously smooth outer surface 30** of the compliant portion.

It is an important part of the method that material displaced at the ends of the compliant portion 104 and in a longitudinal direction of the pin should be displaced in an unrestricted manner. This lack of restriction is conveniently provided by the open ends 99 to the cavity 94 as provided by the simple straight through rectilinear forms of the surfaces 86 and 88. As can be seen from FIG. 15, as the punch 76 descends, it enters into the preform 104 (FIG. 16) to displace the material as described above and, with the assistance of inclined corners 106 of the end of the punch 76, some of the preform material is also displaced longitudinally. A comparison of FIGS. 15 and 16 shows that the finished compliant pin 12 extends further towards the ends 99 of the mold cavity 94 than does the preform 104. This allowance for unrestricted movement of the material at the ends of the preform in a longitudinal direction of the pin, has the effect not only of allowing for a simple and economic structure for the mold parts, but also enables a natural flow of the material to be produced. Hence the transition zones 38 are more naturally and smoothly formed than would be the case with a completely enclosed mold cavity. Thus the transition zones, which are of acceptable strength, are easily formed without difficultly formed mold shapes.

The cross-sectional area of each compliant portion is greater than that of its associated end portion 14 and neck portion 16. This is to ensure no undue weakening at the transition zone such as would be occasioned by a reduction in the area in the compliant portion from that found in adjacent regions of the pin. It will be noted that the portion 68 of each pin which is formed prior to the formation of the preform 104 is of greater cross-sectional area than the end portion 14 (see above). According to the process, as each preform is made and each compliant portion is subsequently made from each preform, there is substantially no removal of material except for the slight amount of material which is caused to flow into the transition zones during downward movement of the punch 76. As a result, the cross-sectional area of each compliant portion is only slightly less than the cross-sectional area of the portion 68 from which the compliant portion has been made. Thus the process ensures that the cross-sectional area of a compliant portion is greater than the cross-sectional area of adjacent regions of the associated pin.

As can be seen from the above, the apparatus for manufacture of each circuit board pin is relatively simple in manufacture and provides a method of displacement molding of compliant portions which avoids the series of steps normally provided for formation of the conventional C-shaped circuit board pins. Thus, very little work hardening of the compliant portion results such as would produce brittleness and thus weakening of the structure during deformation in use. In fact, while a little work hardening may result during formation of the groove 34, this will mainly occur in the hinge region 26 of each compliant portion and will result in a strengthening of the structure as a whole.

Further to this, because the mold parts are closed around the preform before deformation by the punch 76, then the material cannot flow between two mating parts (such as may occur in formation of more conventional compliant portions) whereby the flash at the sides of the compliant portions is minimized. Thus, any problems associated with flash in the use of circuit board pins is avoided. In addition to this, because of the lateral stability of each compliant portion within the mold cavity 94 and the symmetrical downward movement of the punch 76, the chance of asymmetry in the finished compliant portion is minimized. It follows that there is a reduced tendency for circuit board pins made by the method and apparatus described above to rotate or distort when assembled to circuit boards.

Further, if it is required to strengthen or weaken the compliant portion of circuit board pins as described above and according to the invention, so as to produce a compliant pin having specified strength requirements, then this can be easily achieved by simply altering the lowest position of movement of the punch 76. As can be seen from this, the lower end 96 of the punch can be varied in its distance from the mold surface 88 whereby the total depth of the hinge region 26 and thus the thickness of each of the beams 24 can be controllably varied.

What is claimed is:

1. A circuit board pin having a compliant portion extending along part of its length and another portion extending from the compliant portion, the pin comprising two beams extending along the compliant portion, the beams extending laterally from and integrally joined together by a resilient hinge region of the compliant portion for resilient movement of the beams towards each other, the beams also increasing in thickness laterally away from the hinge region and having opposing inner surfaces diverging from the hinge region to define an inwardly tapering groove between the beams, the compliant portion having a convex continuously smooth outer surface which extends around the beams and the hinge region, the entire outer surface being adapted to lie on the perimeter of an oval, and the beams merging at one end of the compliant portion into the other pin portion at a transition zone whereby when the pin is inserted into a circular circuit board aperture, the ends of the beams and the hinge region cannot penetrate the wall of the aperture before the remainder of the outer surface.

2. A compliant pin according to claim 1 having a further portion extending from the other end of the compliant portion and the beams merging at the other end of the compliant portion into the further portion at another transition zone.

3. A compliant pin according to claim 1 in which the compliant portion has a cross-sectional area in a section normal to its length which is at least equal to that of the other portion at a cross-section normal to its length.

4. A compliant pin according to claim 2 in which the compliant portion has a cross-sectional area in a section normal to its length which is at least equal to that of the other portion at a cross-section normal to its length.

5. A compliant pin according to claim 1 wherein at the transition region, the beams merge together while providing a progressive reduction in depth and width of the groove.

6. A compliant pin according to claim 3 wherein at the transition region, the beams merge together and with the compliant portion while providing a progressive reduction in depth and width of the groove.

* * * * *